US007458304B1

(12) United States Patent
Bennett et al.

(10) Patent No.: US 7,458,304 B1
(45) **Date of Patent: *Dec. 2, 2008**

(54) MORTAR BOMB VACUUM POSITIONING APPARATUS

(75) Inventors: Leon J. Bennett, Voorheesville, NY (US); Donald G. Forkas, Rexford, NY (US); George E. Hathaway, IV, Sprakers, NY (US); Ronald G. Gast, Cohoes, NY (US); Ronald S. Jacobs, Contoocook, NH (US); Henry Sneck, West Sand Lake, NY (US)

(73) Assignee: United States of America as represented by The Secretary of the Army, Washington, DC (US)

( * ) Notice: Subject to any disclaimer, the term of this patent is extended or adjusted under 35 U.S.C. 154(b) by 219 days.

This patent is subject to a terminal disclaimer.

(21) Appl. No.: 11/427,092

(22) Filed: Jun. 28, 2006

(51) Int. Cl.
*F41F 1/06* (2006.01)

(52) U.S. Cl. ..... 89/1.35; 89/1.1

(58) Field of Classification Search ..... 89/1.1, 89/1.11, 1.35, 37.05, 45
See application file for complete search history.

(56) References Cited

U.S. PATENT DOCUMENTS

| | | | | | |
|---|---|---|---|---|---|
| 1,462,500 | A * | 7/1923 | Wells | 89/1.1 |
| 1,757,675 | A * | 5/1930 | Methlin | 89/1.35 |
| 2,382,225 | A * | 8/1945 | Hochstetler | 89/1.35 |
| 2,809,624 | A * | 10/1957 | Becher et al. | 124/77 |
| 2,882,796 | A * | 4/1959 | Clark, et al. | 89/7 |
| 4,660,458 | A * | 4/1987 | von Laar et al. | 89/25 |
| 4,982,646 | A * | 1/1991 | Machmer | 89/1.35 |
| 5,677,507 | A * | 10/1997 | Becker et al. | 89/47 |
| 7,040,211 | B1 * | 5/2006 | Bennett et al. | 89/1.35 |
| 2004/0244572 | A1 * | 12/2004 | Borgwarth et al. | 89/17 |

* cited by examiner

*Primary Examiner*—Bret Hayes
(74) *Attorney, Agent, or Firm*—John F. Moran

(57) ABSTRACT

A mortar munition includes a mortar tube; an opening in the wall of the mortar tube; a spring loaded valve assembly disposed in the opening in the wall of the mortar tube; a solenoid having a plunger, the plunger being disposed to open the spring loaded valve assembly; and a vacuum source connected to the spring loaded valve assembly.

5 Claims, 2 Drawing Sheets

FIRE CONTROL COMPUTER
VACUUM SOURCE
10
12
14
16
18
20
22
24
26
28
30
32
54

MORTAR BOMB VACUUM POSITIONING APPARATUS

STATEMENT OF GOVERNMENT INTEREST

The inventions described herein may be manufactured, used and licensed by or for the U.S. Government for U.S. Government purposes.

BACKGROUND OF THE INVENTION

The invention relates in general to mortar munitions and in particular to breech loaded mortar munitions.

In the past, mortars have been muzzle loaded. With muzzle loaded mortars, the position of the mortar bomb in the mortar tube is not an issue. In a breech loaded mortar, the mortar bomb may be loaded by a mechanical auto loader. The bomb is placed forward of the correct firing position to insure that the bomb is not struck by the breech block as it is closed. After the breech block is closed, the bomb must be moved back against the breech block. When the mortar tube is in an elevated position, gravity will move the bomb back against the breech block. When the mortar tube is horizontal or nearly horizontal, the force of gravity is not sufficient to move the bomb back against the breech block. Thus, there is a need for a device to move mortar bombs back against the breech block when the mortar tube is horizontal or nearly horizontal.

SUMMARY OF THE INVENTION

A primary object of the invention is to provide an apparatus to move a breech loaded mortar bomb back against the breech block, when the mortar tube is horizontal or nearly horizontal.

One aspect of the invention is a mortar munition comprising a mortar tube; an opening in the wall of the mortar tube; a spring loaded valve assembly disposed in the opening in the wall of the mortar tube; and a solenoid having a plunger, the plunger being disposed to open the spring loaded valve assembly. A vacuum source is connected to the spring loaded valve assembly. The solenoid is attached to a recoilless mass. A fire control computer is electrically connected to the solenoid.

The spring loaded valve assembly comprises a valve disposed in a housing, the housing being disposed in the opening in the wall of the mortar tube; a valve cap on one end of the valve, the valve cap for interacting with the solenoid plunger; and a compression spring disposed around the valve for keeping the valve normally closed. A vacuum connection is rotatably attached to the housing.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1:
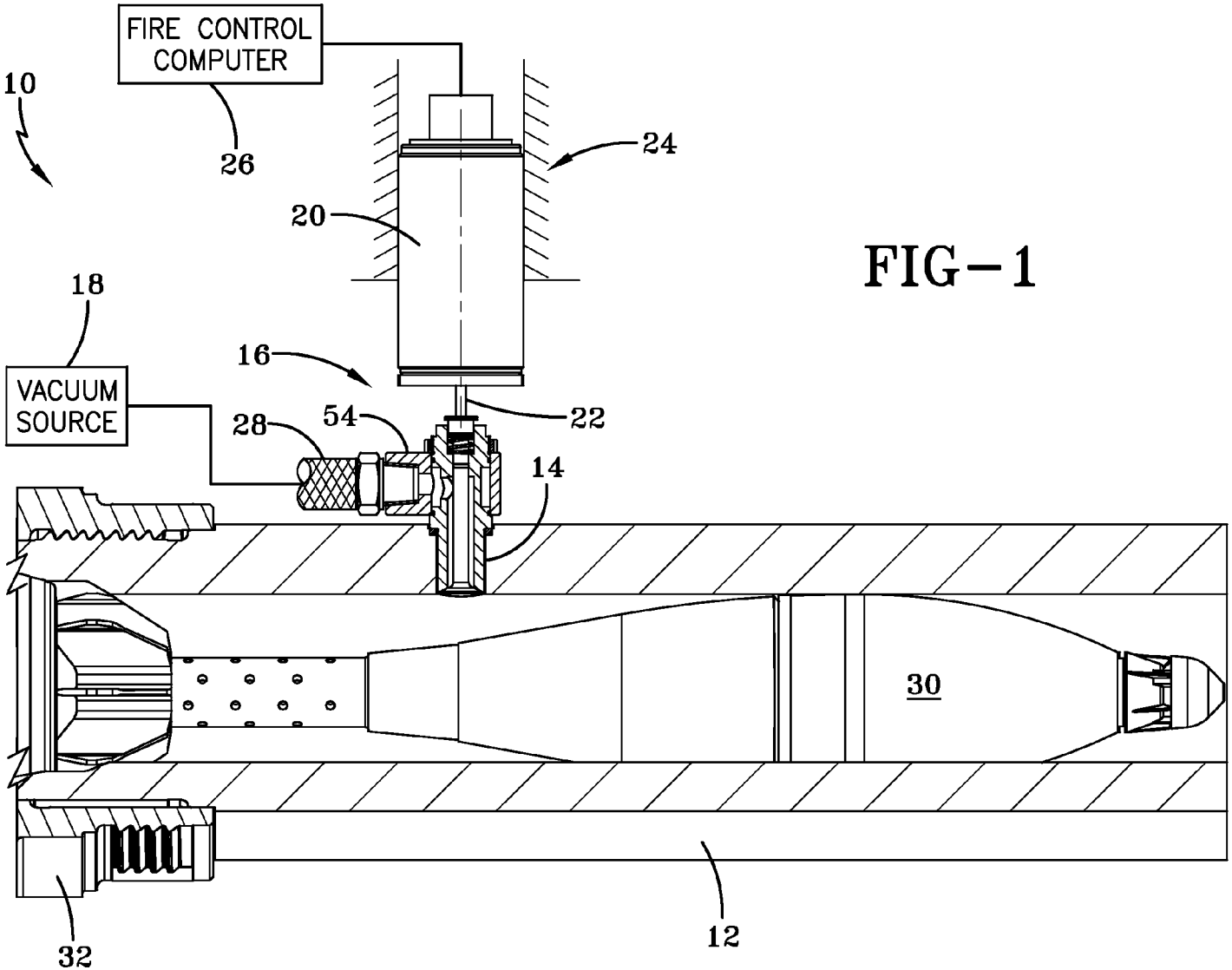
FIG. 1 is a side view, partially in section, showing one embodiment of a mortar munition in accordance with the invention.

Referring to FIG. 1, one embodiment of a mortar munition 10 in accordance with the invention includes a mortar tube 12 having an opening 14 in its wall. A spring loaded valve assembly 16 is disposed in the opening 14 in the wall of the mortar tube 12. A solenoid 20 includes a plunger 22 that is disposed adjacent the spring loaded valve assembly 16. The plunger 22 is operable to open the spring loaded valve assembly 16. A vacuum source 18 is connected to the spring loaded valve assembly 16 via a vacuum line 28 and vacuum connection 54.

The munition 10 includes a recoilless mass 24. The recoilless mass 24 may be any part of the munition 10 that does not recoil when the mortar bomb 30 is fired and is suitable for supporting the solenoid 20. Solenoid 20 is mounted to the recoilless mass 24. A fire control computer 26 is electrically connected to the solenoid 20. Computer 26 determines when plunger 22 will open the spring loaded valve assembly 16.

Figure 2:
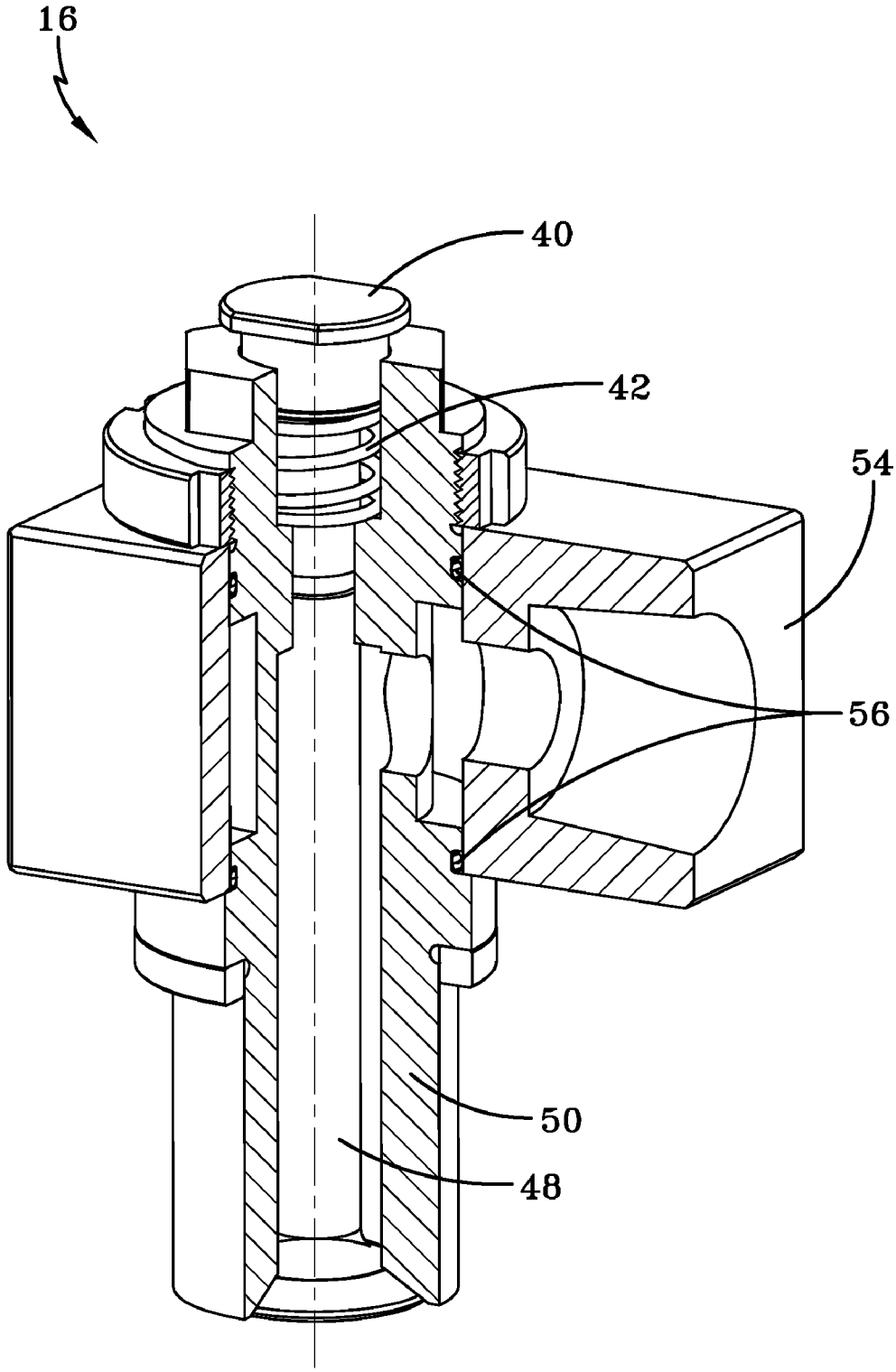
FIG. 2 is a perspective view, partially in section, of one embodiment of a spring loaded valve assembly.

Referring to FIG. 2, the spring loaded valve assembly 16 comprises a valve 48 disposed in a housing 50. The housing 50 is disposed in the opening 14 in the wall of the mortar tube 12. One end of the valve 48 includes a valve cap 40 that interacts with the solenoid plunger 22. A compression spring 42 is disposed around the valve 48 for keeping the valve 48 normally closed. A vacuum connection 54 is attached to the housing 50. The vacuum connection 54 is preferably rotatable around the housing 50. To this end, O-rings 56 seal the vacuum connection 54 to the housing 50. The rotatable vacuum connection 54 is desirable so that the vacuum line 28 may be connected to the assembly 16 in any orientation.

In operation, the mortar bomb 30 is loaded into the mortar tube 12 and the breech 32 is closed. The mortar bomb 12 is pushed forward of the correct firing position so that the breech 32 will not strike the bomb 12 when the breech is closed. When the fire control computer 26 senses that the breech 32 is closed, a signal is sent to solenoid 24 and plunger 22 pushes on valve cap 40 to open valve 48. When valve 48 is open, vacuum source 18 is fluidly connected to the space behind the maximum diameter portion of mortar bomb 30, thereby pulling the bomb 30 rearward to its correct firing position. The correct firing position is shown in FIG. 1. Plunger 22 then retracts and compression spring 42 forces valve 48 to the normally closed position. The mortar munition 10 may then be fired. During recoil, the plunger 22 is not in contact with the valve cap 40 so that the assembly 16 is free to recoil with the tube 12.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A mortar munition, comprising:

a mortar tube;

an opening in the wall of the mortar tube;

a spring loaded valve assembly disposed in the opening in the wall of the mortar tube;

a solenoid having a plunger, the plunger being disposed to open the spring loaded valve assembly;

a vacuum source connected to the spring loaded valve assembly; and a recoilless mass, the solenoid being attached to the recoilless mass.

2. The mortar munition of claim 1 further comprising a fire control computer electrically connected to the solenoid.

3. The mortar munition of claim 1 wherein the spring loaded valve assembly comprises a valve disposed in a housing, the housing being disposed in the opening in the wall of the mortar tube; a valve cap on one end of the valve, the valve cap for interacting with the solenoid plunger; and a compression spring disposed around the valve for keeping the valve normally closed.

4. The mortar munition of claim 3 further comprising a vacuum connection attached to the housing.

5. The mortar munition of claim 4 wherein the vacuum connection is rotatably attached to the housing.

* * * * *